United States Patent [19]

Bernard et al.

[11] 4,329,551

[45] May 11, 1982

[54] ALTERNATING CURRENT INTERRUPTER WITH MAGNETIC ARC EXTINGUISHING MEANS

[75] Inventors: Georges Bernard, Saint-Egreve; Pierre Leclercq, Moirans, both of France

[73] Assignee: Merlin Gerin, Grenoble, France

[21] Appl. No.: 91,365

[22] Filed: Nov. 5, 1979

[30] Foreign Application Priority Data

Nov. 10, 1978 [FR] France ..... 78 32206

[51] Int. Cl.[3] ..... H01H 33/18

[52] U.S. Cl. ..... 200/147 R; 200/148 B

[58] Field of Search ..... 200/147 R, 148 B

[56] References Cited

U.S. PATENT DOCUMENTS 2,294,801 9/1942 Rawlins ..... 200/147 R

FOREIGN PATENT DOCUMENTS 2285700 4/1976 France .

2368792 5/1978 France .

2511238 9/1975 Netherlands .

*Primary Examiner*—Robert S. Macon

*Attorney, Agent, or Firm*—Stevens, Davis, Miller & Mosher

[57] ABSTRACT

An alternating current interrupter is contained in a sealed elongated housing filled with dielectric gas, such as SF6. The interrupter comprises a pair of separable stationary and movable contacts and a magnetic blow-out arc extinguishing device including an annular coil disposed coaxially with a first ring-shaped electrode which surrounds the stationary contact. The coil produces a radial magnetic field in the arcing zone causing the arc to rotate rapidly along the first electrode which is secured to the inner edge of the coil's front face in order to reduce the electrodynamic repulsion forces between said coil and electrode. A metallic shield is disposed between the arcing zone and the outer portion of the front face which is not covered by the first electrode.

18 Claims, 1 Drawing Figure

ALTERNATING CURRENT INTERRUPTER WITH MAGNETIC ARC EXTINGUISHING MEANS

Figure 1:
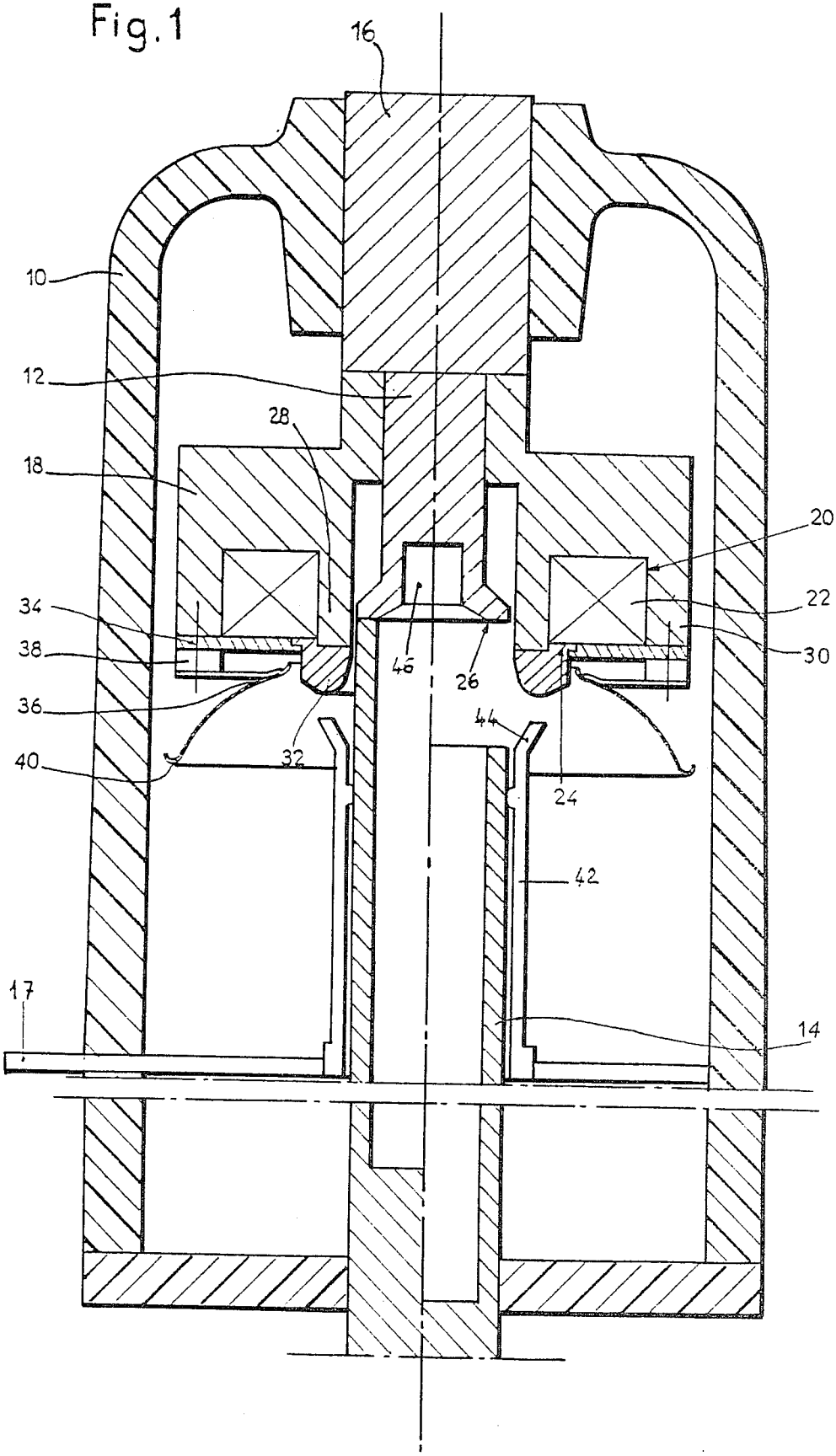

This invention relates to an alternating current interrupter having a magnetic blow-out are extinguishing device comprising:

a sealed housing made of insulating material and filled with a dielectric gas, a pair of separable contacts, a first ring-shaped electrode associated to one of said contacts, an annular coil disposed coaxially with said first electrode so as to produce a magnetic field extending in the arcing zone between the open contacts which causes the arc to rotate rapidly along said first electrode,.

In prior-art interrupters employing the general concept of arc spinning, the radial front face of the electromagnetic coil forms a ring-shaped arcing runner made of good conductive material. The magnetic field induces circulating currents in the arcing runner, and important electrodynamic repulsion forces are created between the coil and the arcing runner which limit the breaking capacity of theses interrupters.

The principal object of this invention is to improve interrupters of the above described type so as to increase their breaking capacities.

Therefore, in accordance with an important aspect of the invention, the first electrode associated to one of the contacts, includes a ring of predetermined thickness made of good conductive material which is secured to the inner edge of the front face of said coil so as to cover a small portion of said front face to reduce the electrodynamic repulsion forces between said electrode and coil.

A metallic shield is disposed between the arcing zone and the outer portion of said front face which is not covered by said first electrode. The magnetic field produced by the coil also induces circulating currents in the metallic shield, but the influence of these induced currents are limited by using a shield which is provided with a thin wall made of a material having a low electrical conductivity.

The section of the first ring-shaped electrode is substantially contained in a circle, and the centre of gravity of the induced current lines coincides with the centre of the circle.

In accordance with another feature of the invention, the coil is firmly secured to a metallic bracket to which the first ring-shaped electrode is brazed. The bracket is made of a ferromagnetic material, such as soft iron, which increases the magnetic field during breaking of small currents.

A second ring-shaped electrode is disposed in front of said first electrode, both electrodes having nearly the same diameter, whereby the arc extends in a zone of maximum field produced by the induced currents in said first electrode.

The above and other objects and advantages of the invention will become apparent from the following description of an embodiment of the invention given by way of example only and shown in the annexed drawing which is a vertical partial sectional view of a circuit interrupter with arc-rotating means, the left and right parts showing respectively the closed and opened positions of the interrupter.

With reference to the FIGURE, a sealed housing 10 of a suitable insulating molded material, is filled with dielectric medium, such as sulfur hexafluoride gas (SF6) at atmospheric pressure or at elevated pressure. The elongated housing 10 includes a stationary contact 12 cooperating in the closed position with a slidable longitudinally movable contact 14, both contacts being arranged in axial alignment inside said housing, and electrically connected to terminals 16, 17. The dielectric gas escapes through the hollow movable contact 14 during arc-extinguishing operation.

The stationary contact 12 is coaxially surrounded by a fixed bracket 18 having an annular recess 20 for receiving a blow-out blast coil 22. The lower front face 24 of coil 22 is located near the axial level of the end 26 of stationary contact 12 which comes into engagement with movable contact 14 in the closed position of the interrupter. Coil 22 is firmly inserted within recess 20 between an inner collar 28 and an outer collar 30 of bracket 18. Outer collar 30 forms a binding around coil 22 which is firmly held in position during energization by high currents. An annular intermediate electrode 32 of good conductive and arc resistant material is fastened to the end of inner collar 28 and projects over the end 26 of contact 12. Electrode 32 comprises a protruding flange secured to the inner edge of the front face 24 of coil 22. Electrode 32 is formed by a ring-shaped member having a predetermined thickness and a section which is nearly contained in a circle.

Bracket 18 is a metallic and ferromagnetic material, such as mild steel, and electrode 32 is soldered or brazed to the collar 28 so as to form a unity with bracket 18 and coil 22. Front face 24 has an outer portion which is not covered by the protruding flange of electrode 32 but by an annular disc 34 carrying a shield 36 which deflects the hot gases. A ring 38 of insulating material is interposed between disc 34 and shield 36 which surrounds coaxially electrode 32. Shield 36 comprises an extension 40 having the shape of a truncated cone which surrounds the arcing zone and extends radially towards the inner wall of housing 10. Coil 22 is electrically connected at one end to the stationary contact 12 and to electrode 32 at its other end.

An auxiliary and stationary electrode 42 of tubular shape is associated coaxially to movable contact 14 is is provided with an annular upper conductive end 44 disposed in front of electrode 32 having the same diameter and longitudinally spaced from end 44 by a predetermined axial distance corresponding to optimum arc extinguishing condition. An axial slot 46 is centrally arranged within end 26 of the stationary contact 12, and conductive electrode 42 is longitudinally slotted to prevent its appearance as a short-circuited turn.

The interrupter operates as follows:

In the closed position of interrupter shown on the left part of the drawing, the movable contact 14 engages the stationary contact 12, and current flows from upper terminal 16 towards lower terminal 17 through closed contacts 12, 14 which shunt the coil 22. In order to open the interrupter, the movable contact 14 is actuated downwardly by an operating mechanism (not shown), and an arc is drawn between the open contacts 12, 14. This arc is rapidly transferred to electrodes 32 and 42, and the arc current flows now through coil 22 producing in the arcing zone a radial magnetic field, which causes the arc to rotate very rapidly around electrodes 32, 42. The arc rotation occurs in the middle zone of housing 10, and electrodes 32, 42 form ring-shaped arc runners having each a small radial breadth. The insulating ring 38 prevents the arc to be transferred to the extension 40 of shield 36. The mutual coupling between coil 22 and the closed electrode 32 induces important circulating currents in electrode 32 since it is a short-circuit winding. These circulating currents are out of phase with the current flowing in coil 22 so as to maintain a sufficient magnetic field between the spaced electrodes 32, 42 as the arc current approaches current zero to ensure rotational movement of the arc current through the dielectric gas. It will be noted that the arc extends near the centre of gravity of the induced current lines in electrode 32 where exists the maximum magnetic field. The arc current is then extinguished as it passes through a current zero.

The electrodynamic repulsion forces between coil 22 and electrode 32 are limited by the reduced radial dimension of electrode 32, and are taken over by the mechanical fastening of electrode 32 to the stationary bracket 18. Only a small inner portion of the front face 24 of coil 22 is covered by electrode 32, the other larger outer portion carrying disc 34 and shield 36 of small thickness and made of a metallic material having a low electrical conductivity, such as stainless steel. The insulating currents induced in disc 34 and shield 36 are very limited, so that bracket 18 is capable of withstanding the electrodynamic repulsion forces produced during arc extinguishing operation. Shield 36 protects the front face 24 of coil 22, and its extension 40 deflects the hot gases and acts also as a condensing wall. The ferromagnetic bracket 18 increases the magnetic field produced by small currents so as to move the rotating arc at sufficient velocity to cause its effective interruption. The axial slot 46 avoids the migration of the arc roots towards the centre of the stationary contact 12. The longitudinal slot of electrode 42 reduces the induced currents and the electrodynamic repulsion forces. Although the present invention has been described with respect to a preferred embodiment, it should be understood that many variations and modifications will now be obvious to those skilled in the art. The auxiliary tubular electrode 42 may be avoided and the arc is then drawn between electrode 32 and the movable tubular contact 14.

What we claim is:

1. An alternating current interrupter having a magnetic blow-out arc extinguishing device comprising:

a sealed housing made of insulating material and filled with a dielectric gas, a pair of separable contacts, a first ring-shaped electrode associated to one of said contacts, so that the arc drawn between the separated contacts is transferred to said first electrode, an annular coil disposed coaxially with said first electrode so as to produce a magnetic field extending in the arcing zone between the open contacts which causes the arc to rotate rapidly along said first electrode, said first electrode including a ring of predetermined thickness in the axial direction made of good conductive material which is secured to the inner edge on the arcing zone side of the front face of said coil so as to cover only a small portion of said front face to reduce the electrodynamic repulsion forces between said electrode and coil, and a metallic shield made of low conductive material disposed between the arcing zone and the outer portion of said front face which is not covered by said first electrode.

2. The interrupter of claim 1, wherein said metallic shield has a small cross section and said interrupter further comprises a second longitudinally slotted ring-shaped electrode disposed in front of said first electrode, both electrodes having nearly the same diameter, so that the arc extends in a zone of maximum field produced by the induced currents in said first electrode.

3. The interrupter of claim 1, wherein said metallic shield has a small cross section.

4. The interrupter of claim 1 or 3, wherein the section of said first ring-shaped electrode is substantially contained in a circle so as to concentrate the induced currents in said first electrode.

5. The interrupter of claim 1 or 3, further comprising a ferromagnetic bracket having inner and outer collars, said annular coil being inserted between said collars and said first electrode being firmly secured to the front edge of said inner collar.

6. The interrupter of claim 1, wherein said metallic shield is of small thickness and is made of a metallic material having a low electrical conductivity which reduces the magnitude of the circulating currents induced by the magnetic field in said shield.

7. The interrupter of claim 1 or 3, wherein said metallic shield extends towards the inner wall of the housing so as to deflect the hot ionized gases.

8. The interrupter of claim 1 or 3, wherein said pair of separable contacts includes a stationary contact extending coaxially within said coil which is provided with a contact end axially spaced from said front face carrying said first electrode, and a longitudinally movable contact cooperating with said stationary contact so as to draw an axial arc which is rapidly transferred to the first electrode to energize said coil.

9. The interrupter of claim 8, wherein an axial slot is arranged in the center of the contact end of said stationary contact so as to position the arc roots on the outer edge of the contact.

10. The interrupter of claim 2, wherein said second electrode is axially spaced from the first electrode by a predetermined distance corresponding to optimum arc extinguishing conditions.

11. A circuit interrupter having a magnetic blow-out are extinguishing device comprising:

substantially sealed housing means for containing a dielectric gas;

first and second primary contact means for conduction therebetween, said second primary contact means being movable relative to said first primary contact means in an axial direction from a first position in which said first and second primary contact means are in electrical contact to a second position in which the electrical contact is interrupted;

means forming a first secondary contact means electrically associated with said first primary contact means positioned so that when said first and second primary contact means are in said second position the arc drawn between said primary contact means is transferred to said first secondary contact means;

coil means disposed substantially coaxially with said first secondary contact means for producing a magnetic field extending in the arcing zone between said first and second primary contact means in said second position which causes the arc to rotate rapidly along said first secondary contact means, said coil means being shunted when said primary contact means are in said first position and said coil means is energized when said arc is transferred from said first primary contact means to said first secondary contact means, said coil means comprising means forming a face extending substantially in a radial direction relative to the center of said coil means;

said first secondary contact means comprising ring means for reducing the electrodynamic repulsion, said ring means being made of conductive material and being secured to said face means, said ring means being sufficiently sized so as to cover only a small portion of said face means to thereby reduce the electrodynamic repulsion between said first secondary contact means and said coil means;

means forming a metallic shield disposed between the arcing zone and the portion of said face means which is not covered by said ring means so as to protect said face means;

whereby due to the sizing of said ring means so as to cover only a small portion of said face means, when said second primary contact means is moved to said second position and a magnetic field is created in said coil means the electrodynamic repulsion forces between said first secondary contact means and said coil means are reduced.

12. The circuit interrupter of claim 11 wherein said first secondary contact means is ring-shaped and said ring means comprises a protruding flange integrally formed thereon, said coil means having a substantially greater outer radial dimension than the outer radial dimension of said first secondary contact means.

13. The circuit interrupter of claim 12 further comprising means forming an annular disc attached to said face means and extending from said first secondary contact means to the outer perimeter of said coil means, said annular disc means being made of a metallic material having a low electrical conductivity and having a radial dimension such that only a small portion of said face means is covered by said ring means and the larger remaining portion of said face means is covered by said annular disc means.

14. The circuit interrupter of claim 11, 12, or 13 wherein said coil means comprises a coil and stationary bracket means for containing said coil, said bracket means being formed of a metallic ferromagnetic material and comprising inner and outer collars whereby said coil is firmly held between said inner and outer collars.

15. The circuit interrupter of claim 11, 12, 13 further comprising second secondary contact means electrically associated with said second primary contact means and extending a predetermined axial distance closer to said first secondary contact means than said second primary contact means when said second primary contact means is in said second position such that the arc is rapidly transferred from said second primary contact means to said second secondary contact means, said predetermined axial distance corresponding to an optimum arc extinguishing condition.

16. The circuit interrupter of claim 11, 12, or 13 wherein said first primary contact means comprises centrally located slot means for positioning the arc roots on the outer edge of said first primary contact means.

17. The circuit interrupter of claim 13 further comprising an insulated ring positioned between said annular disc means and said metallic shield means to prevent the arc from being transferred to said metallic shield means.

18. The circuit interrupter of claim 17 wherein said shield means comprises an extension having the shape of a truncated cone which surrounds the arcing zone and said shield means operates to deflect hot gases.

* * * * *